US005282934A

United States Patent [19]

Cox

[11] Patent Number: 5,282,934

[45] Date of Patent: Feb. 1, 1994

[54] METAL RECOVERY BY BATCH ELECTROPLATING WITH DIRECTED CIRCULATION

[75] Inventor: Luther W. Cox, Albuquerque, N. Mex.

[73] Assignee: Academy Corporation, Albuquerque, N. Mex.

[21] Appl. No.: 837,005

[22] Filed: Feb. 14, 1992

[51] Int. Cl.[5] ..... C25C 1/00; C25C 3/20; C25C 7/00

[52] U.S. Cl. ..... 204/1.11; 204/105 R; 204/228; 204/269; 204/273

[58] Field of Search ..... 204/228, 269, 273, 105 R, 204/109, 275, 237, 1.11

[56] References Cited

U.S. PATENT DOCUMENTS

| | | | |
|---|---|---|---|
| 675,459 | 6/1901 | Yunck | 204/273 |
| 905,048 | 11/1908 | Beaumont | 204/229 |
| 951,311 | 3/1910 | Hartman | 204/152 |
| 1,362,082 | 12/1920 | Cowper-Coles | 204/273 X |
| 1,411,657 | 4/1922 | Duncan | 204/273 |
| 2,307,928 | 2/1939 | Hogaboom | 204/141 |
| 2,989,445 | 1/1958 | Lloyd et al. | 204/28 |
| 2,997,438 | 6/1958 | James et al. | 204/273 |
| 3,415,732 | 10/1968 | Komjathy | 204/237 |
| 3,450,622 | 6/1969 | Cothran | 204/234 |
| 3,503,856 | 3/1970 | Blackmore | 204/273 X |
| 3,551,318 | 12/1970 | Snook | 204/228 |
| 3,558,455 | 1/1971 | Sorensen et al. | 204/105 |
| 3,583,897 | 6/1971 | Fulweiler | 204/212 |
| 3,715,291 | 2/1973 | Bentley | 204/109 |
| 3,751,355 | 8/1973 | Mandroian | 204/228 |
| 3,839,180 | 10/1974 | Takaysu | 204/238 |
| 3,875,032 | 4/1975 | Thompson | 204/109 |
| 3,925,184 | 12/1975 | Cave | 204/229 |
| 3,926,771 | 12/1975 | Lieb et al. | 204/268 |
| 3,959,110 | 5/1976 | Burgess | 204/229 |
| 3,964,990 | 6/1976 | Woyden | 204/109 X |
| 4,018,658 | 4/1977 | Alfin et al. | 204/109 |
| 4,054,503 | 10/1977 | Higgins | 204/271 |
| 4,069,127 | 1/1978 | Salemi | 204/237 X |
| 4,127,465 | 11/1978 | Higgins | 204/228 |
| 4,139,429 | 2/1979 | Steward et al. | 204/105 R |
| 4,139,431 | 2/1979 | Scheidegger et al. | 204/237 X |
| 4,263,108 | 4/1981 | Berg et al. | 204/109 |
| 4,265,431 | 5/1981 | Falomo | 266/101 |
| 4,276,147 | 6/1981 | Epner | 204/275 X |
| 4,302,317 | 11/1981 | Mock | 204/228 |
| 4,302,318 | 11/1981 | Mock | 204/229 |
| 4,319,971 | 3/1982 | Good et al. | 204/109 |
| 4,378,285 | 3/1983 | Castellanos et al. | 204/238 |
| 4,427,505 | 1/1984 | Stevens | 204/109 |
| 4,619,749 | 10/1986 | Nusbaum | 204/228 |
| 4,657,652 | 4/1987 | Hodges | 204/269 |
| 4,728,407 | 3/1988 | Nusbaum | 204/228 |
| 4,800,005 | 1/1989 | Rosenfield et al. | 204/109 |
| 4,834,850 | 5/1989 | de Nora et al. | 204/269 X |
| 4,871,435 | 10/1989 | Denofrio | 204/224 |
| 4,935,109 | 6/1990 | Dugan | 204/269 X |
| 4,960,500 | 10/1990 | Epner | 204/269 |
| 4,981,559 | 1/1991 | Sato et al. | 204/14.1 |
| 5,017,273 | 5/1991 | Woog | 204/105 R |
| 5,057,202 | 10/1991 | Maitino et al. | 204/212 |
| 5,062,940 | 11/1991 | Davies | 204/269 X |

OTHER PUBLICATIONS

"Lancy Electrolytic Metal Recovery Cell," Technical Bulletin No. 3201, Lancy International, Inc. (no Date provided).

"MiniMate ® III Recovery System," Brochure, SRA, Inc. (no date provided).

"MPS 500: Non Electrolytic Silver Recovery Pump Stations and Cannisters," Brochure, Academy Corporation (no date provided).

"SilverMate ® I Recovery System," Brochure, SRA, Inc. (no date provided).

"SilverMate ® II Recovery System," Brochure, SRA, Inc. (no date provided).

*Primary Examiner*—Donald R. Valentine

*Attorney, Agent, or Firm*—Deborah A. Peacock; Rod D. Baker

[57] ABSTRACT

The invention is related to apparatuses and methods for recovering metals from solution using electroplating processes. Batch processing of electrolytic solution occurs by circulating electrolytic solution through a specified configuration of anodic and cathodic plates. One or more electrolytic cells are stacked upon a single holding tank. Automatic controls are provided.

73 Claims, 5 Drawing Sheets

METAL RECOVERY BY BATCH ELECTROPLATING WITH DIRECTED CIRCULATION

BACKGROUND OF THE INVENTION (TECHNICAL FIELD)

This invention relates to apparatuses and methods for extracting ionic metals, particularly silver or other precious metals, from photographic and other solutions by electrolytic plating on cathodic plates

BACKGROUND ART

Many electroplating systems have been devised for the purpose of recovering ionic metals, especially silver, from chemical solution. The general process is commonly used to reclaim silver from used photographic fixing solutions, as described, for example, in U.S. Pat. No. 4,619,749 to Nusbaum and U.S. Pat. No. 4,800,004 to Resenfield et. al. The concept of electrolytic recovery from solution has more general application, however, to the recovery of ionized metals from a variety of waste and by-product solutions, as mentioned in U.S. Pat. No. 5,017,273 to Woog and U.S. Pat. No. 5,057,202 to Maitano et al.

Metal ion recovery systems normally include a tank for holding the subject electrolytic solution from which the metal is to be reclaimed. Electrodes are suspended in the solution, including at least one cathode upon which the desired metal is electrolytically plated as a result of a voltage drop across the electrodes. During the electroplating process, a film layer forms on the surface of the cathode. Metal ions are diffused from the electrolyte into this film layer, and then plated upon the surface of the cathode itself. It is desirable, of course, to accomplish the plating process as efficiently as possible without compromising the quality of the electroplate layer.

It is known in the art that, if all other variables (such as current density) remain constant, the rate at which metal ions are deposited upon the surface of the cathode is limited by the rate at which the ions are diffused from the solution into the cathodic film layer. As more completely described in U.S. Pat. No. 4,139,429 to Steward et. al., increasing the metal deposition rate on the cathode increases the depletion rate of metal ions from the cathodic film layer; when the depletion rate from the cathodic film layer exceeds the rate at which ions are extracted from the electrolyte, the current efficiency of the apparatus is impaired and the resulting metal deposits are of poor quality. It is desirable, then, to maximize ion replenishment from the electrolyte into the cathodic film layer. This may be accomplished by agitating the electrolyte and/or the cathode, and by beneficially modifying the electrical and chemical conditions within the cell, which are objects of the present invention.

The "Model 200", manufactured by Academy Corporation, of Albuquerque, New Mexico, is an electrolytic metals recovery system having only one cathode plate and two anode plates, and thus lacks the unique advantageous solution flow pattern of the present invention. The Model 200 also does not include automatic batch processing features of the present invention, but instead has a continuous-processing system.

U.S. Pat. No. 2,989,445 to Lloyd et al. describes a device for electroplating only a single side of a continuous metal strip; agitation of the electrolyte is accomplished by pouring it across a near-horizontal surface of the cathodic strip.

U.S. Pat. No. 3,839,180 to Takaysu discloses a device for chromium plating using an electrolysis tank and a separate tank for filtering, pumping and cooling of the electrolyte; no means for recovering metal ions from solution is described.

U.S. Pat. No. 4,139,429 to Steward et al. describes an electroplating cell utilizing motor-driven rotary impellers to move electrolyte past directional vanes and across the cathodes The '429 disclosure, however, does not describe the use of timed controls for batch processing of solutions.

U.S. Pat. No. 4,619,749 to Nusbaum describes a device for extracting silver ions from electrolytic solution which employes bladed impellers to move electrolytic solution from a primary extraction compartment to a secondary extraction compartment, wherein the plating current in both compartments is electronically calibrated and automatically corrected for the chemistry of the particular solution in use and for variance in the electrolyte's resistance. The '749 Patent does not teach the use of any advantageous flow patterns or electrode configurations, or the use of pumps or distributor tubes for controlling circulation flow and velocity.

U.S. Pat. No. 4,800,005 to Rosenfield et al. describes a device for reclaiming silver from waste photographic solution; agitation of the cathodic film layer is accomplished by rotating circular-shaped cathodic plates through the electrolyte. This system requires extensive maintenance due to the many moving parts.

U.S. Pat. No. 5,057,202 discloses the use of a rotating cathodic barrel to agitate tumbling work pieces upon which the reclaimed metal is electroplated; the electrolyte is repeatedly recycled through the cathodic barrel.

U.S. Pat. No. 4,981,559 to Sato et al. discloses a device using injection nozzles to recirculate electrolyte past work pieces in order to electroplate them, but is not intended for use as a metals reclamation device.

U.S. Pat. No 5,017,273 to Woog describes a device for recirculating electrolyte from a first container into a second container containing a cylindrical cathodic lining upon which the metal ions are electroplated.

The present invention is a patentable advance over the existing background art for a variety of reasons. A number of the present invention's features foster increased diffusion and deposition rates without the usually associated increases in energy costs, required space, and apparatus complexity.

The existing art consists of many apparatuses and methods using a single anode-cathode pair, which permits deposition of reclaimed metal upon only one side or surface of the cathodic element. Increasing the number of electrodes incorporated in the devices can result in unacceptably large increases in the volume of the entire apparatus. Alternatively, other devices in the art permit solution flow across multiple cathodic surfaces, but at the expense of simplicity; many existing devices incorporate elaborate solution and/or electrode agitation mechanisms with many moving parts, resulting in increased maintenance and operation costs.

A survey of the background art also reveals that most existing systems do not accommodate the changing chemical and electrical conditions within the cell during the course of the reclaiming process. Even if they were to attempt to do so, such an effort would be hampered by the contemplated "continuous circulation" aspect of their mode of operation. The systems of the present invention, which repeatedly recirculate a single batch of electrolyte, permit timed alterations in the amperage and/or chemistry of the cell, in order to maximize the recovery of the desired ion over the course of the complete process The aforementioned limitations, individually or in various combinations, hamper the overall efficiency of electroplating recovery systems presently in general use. The present invention provides a faster process, utilizing less energy and requiring less maintenance.

SUMMARY OF THE INVENTION (DISCLOSURE OF THE INVENTION)

The invention includes apparatuses and methods for reclaiming metals, most particularly silver, from electrolytic solutions such as spent photographic fixatives. Ion-bearing solution is processed in batches. In the preferred embodiment, the solution is pumped from a single holding tank into one or more electrolytic cells mounted on top of the holding tank. Within each cell the solution is then circulated between and among two cathodic plates parallelly interposed between three anodic plates. A novel flow pattern among the electrodes is maintained by continuous injection pumping through particularly placed perforated tubes. Electroplating of the target ion occurs on dual faces of each cathode. When a given batch has been completely processed, the cells and tank are drained, the plated cathodes stripped (after several batches), and the system made ready for the next batch.

The filling, plating and dumping cycles are automated and electronically controlled. Electronic sending units detect and signal when the holding tank or a particular electrolytic cell is filled to the requisite level with electrolyte; microprocessors direct the initiation of the next processing cycle by signalling the actuation and/or shut down of pumps, the opening of drain valves, etc., at determined flow rates. Additionally, a system chronometer is used to track the elapsed times during the process. System chemical changes or temperatures can be monitored and controlled A master control panel can thus be preprogrammed to direct the processing of an entire batch or several batches.

An object of the present invention is to provide electrolytic metal recovery apparatuses and methods with increased efficiency.

Another object of the present invention is to provide an electrolytic metal recovery system that incorporates few moving parts, in order to minimize maintenance and operating costs.

An advantage of the present invention is that it provides an expandable and stackable electrolytic metal recovery apparatus that permits the use of multiple electrodes in a minimum of floor space.

Another object of the present invention is to provide a system for electrolytic metal recovery that permits a plurality of electrolytic cells to be served and controlled from a single rectifier and single control panel.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DESCRIPTION OF THE PREFERRED EMBODIMENT (BEST MODE FOR CARRYING OUT THE INVENTION)

The invention relates to improved systems for recovering precious and other metals from spent photographic fixing solutions, or other solutions containing metal ions. Building upon basic electrolytic plating techniques, the invention introduces improved means for maintaining a uniform solution flow parallel to cathode plates The invention offers the advantage of few moving parts. It is also expandable, permitting the user to choose the number of electrolytic cells to be used with a single holding tank during a given course of treatment depending upon solution volume and time considerations. The invention allows batch processing of electrolyte, and includes features for controlling the addition of pH adjustment or other additives (e.g. sulfites) by means of an adjustable, timed output for operating a pump or pumps.

Figure 8:
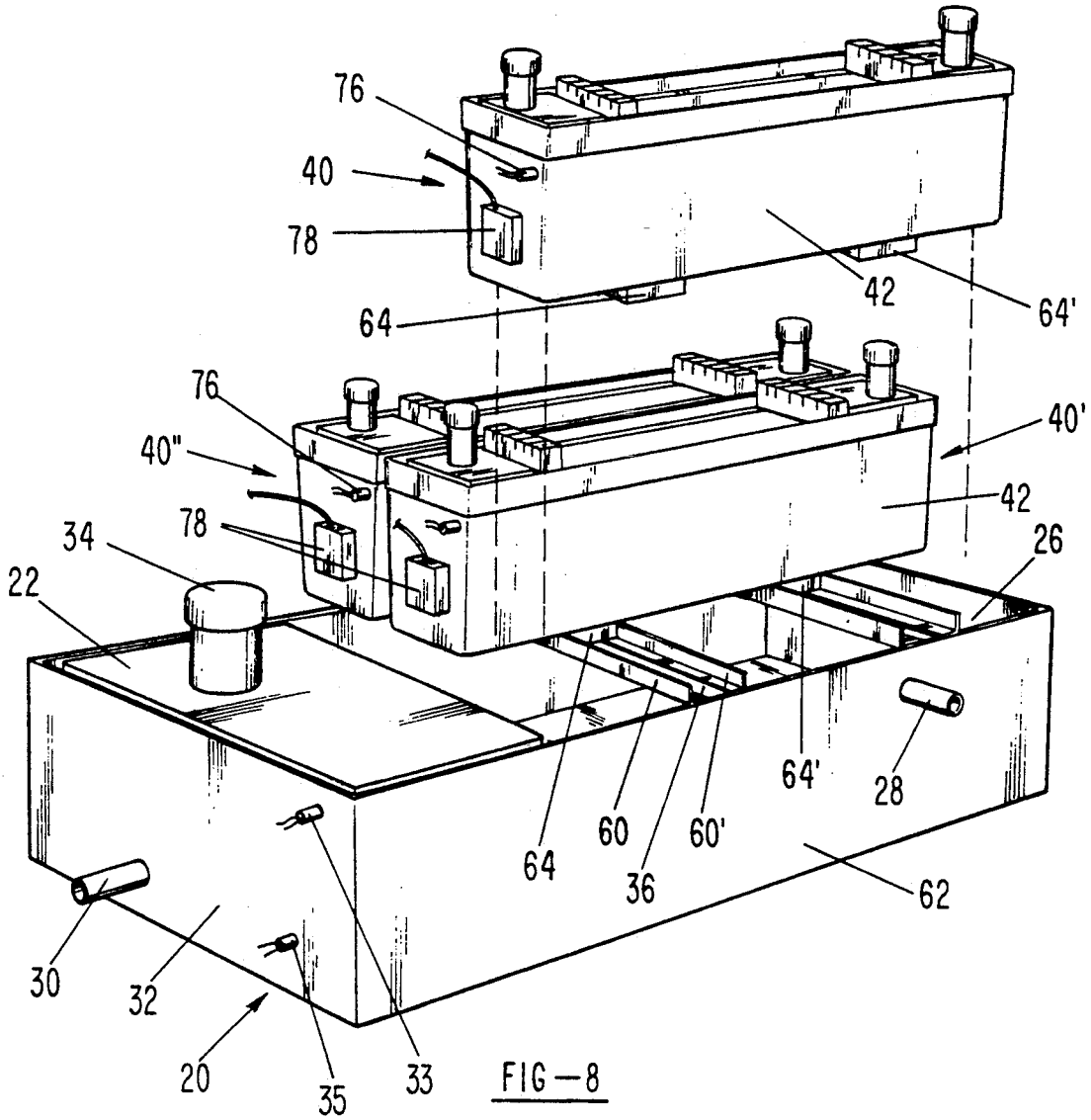
FIG. 8 is a partially exploded perspective view of the holding tank and three electrolytic cells of the preferred embodiment of the invention.

Reference is now made to the drawings, which illustrate the preferred embodiment of the present invention. Initial reference is made to FIG. 8, illustrating holding tank 20. Among other vital purposes, holding tank 20 serves as a support base. An advantage of the present invention is that one or more electrolytic cells 40,40',40" may be stacked upon holding tank 20; accordingly, holding tank 20 must be of sturdy and durable construction. In the preferred embodiment, holding tank 20 is of oblong rectangular construction and has a holding capacity of approximately 600 gallons; holding tank 20 should have a minimum capacity of at least 200% of the total volume of the maximum number of electrolytic cells 40,40',40" to be placed thereon. It is composed of any strong material resistant to the corrosive effects of electrolytic solutions; preferably it is constructed of fiberglass or fiberglass-lined stainless steel (although various inert plastics known in the art may as well serve as lining material).

Holding tank 20 has holding tank top 22, including top edge 26 about the top perimeter surrounding holding tank opening 36. Although FIG. 8 illustrates a portion of holding tank 20 as open, it can be completely covered. Securely attached horizontally across the full width of holding tank opening 36 cell support brackets 60,60'. Description of a single pair of cell support brackets 60,60' serves to describe the other cell support brackets as well. As illustrated in FIG. 8, cell support brackets 60,60' are preferably composed of lengths of fiberglass, but can be angle bracket or corrosion resistant "angle-iron" having a right-angle or L-shaped cross section. Cell support brackets 60,60' are paired with their included right angles facing or opposing each other, to serve in concert as a channel-like holding means for a single or several electrolytic cells 40. Alternatively, cell support brackets can be disposed 90° to those shown in FIG. 8, so that each cell 40 slides within its own cell support brackets.

Figure 2:
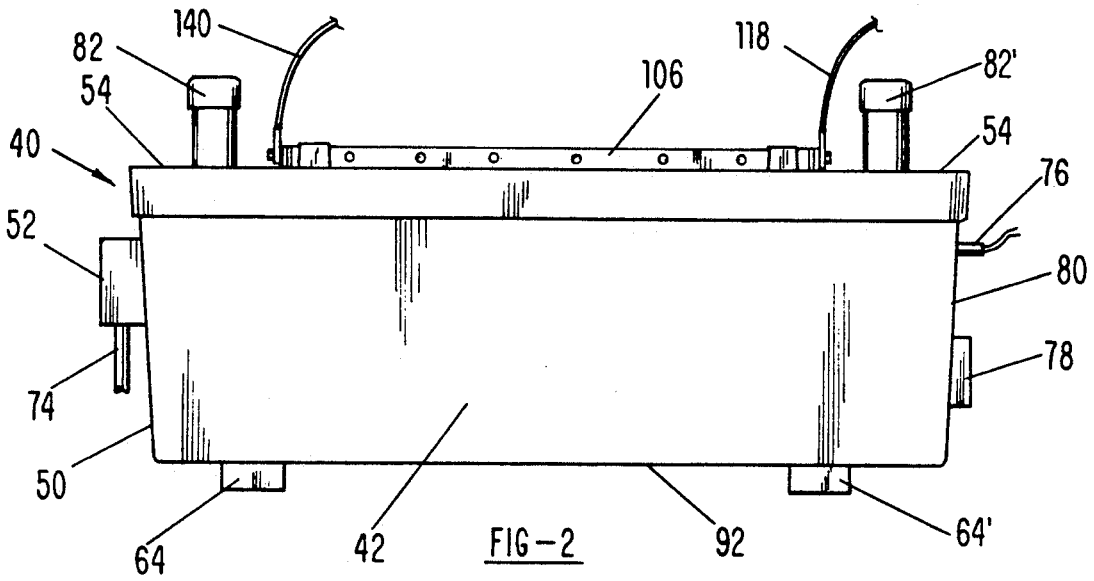
FIG. 2 is a front view of the FIG. 1 embodiment.
Figure 3:
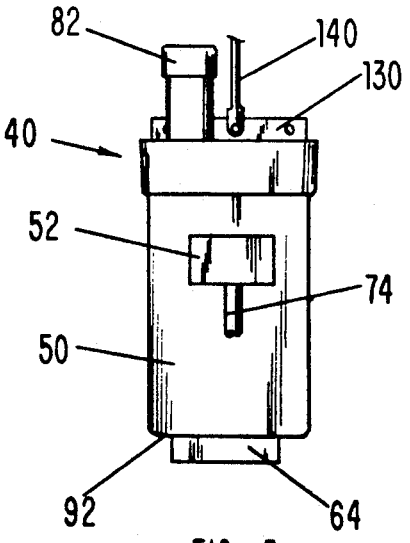
FIG. 3 is a left side view of the FIG. 1 embodiment.
Figure 4:
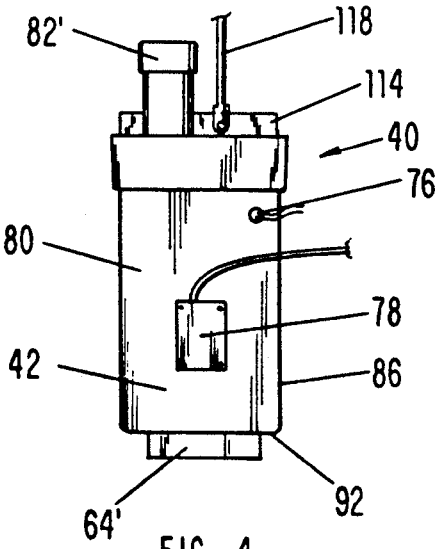
FIG. 4 is a right side view of the FIG. 1 embodiment.

With continued reference to FIG. 8, and added reference to FIGS. 2–4, it is observed that attached to the bottom of each cell 40 are mounting flanges 64,64' to allow the secure yet removable mounting of cell 40 upon holding tank 20 within cell support brackets 60,60'. With particular attention to FIG. 8, it is observed that mounting flanges 64,64' conform to the distance between the upright legs of cell support brackets 60,60', permitting mounting flanges 64,64' to be easily inserted between cell support brackets 60,60'.

This mutuality between mounting flanges 64,64' and cell support brackets 60,60' advances a purpose of the invention: to allow a user easily to practice the invention using one, two, three, or more, electrolytic cells 40. After determining how many cells 40 will optimize ion recovery with a minimum of expended energy, the user can add or remove cells 40 accordingly by performing simple plumbing coupling/uncoupling adjustments and slideably positioning the appropriate number of cells 40 atop holding tank 20 and above holding tank opening 36. A cell 40 is slid or lowered into place with its mounting flanges 64,64' between cell support brackets 60,60'. Cell support brackets 60,60' then hold cell 40 in place; if desired, bolts through aligned holes (not shown) through mounting flanges 64,64' and the upper legs of cell support brackets 60,60' can provide added security. Thus, the number of cells 40 employed while practicing the invention may be easily varied between batch processes, providing flexible processing capacity.

Continued reference is made to FIG. 8. The front 62 of holding tank 20 is fitted with overflow return inlet 28 near holding tank top 22. As further explained hereinafter, overflow return inlet 28 is in fluid connection with the electrolytic cell(s) 40 of the apparatus. Holding tank 20 also has outlet 30, a pipe fitting in side 32 near the bottom of holding tank 20. Outlet 30 also is connected to the cell(s) 40 of the apparatus; electrolyte is pumped from holding tank 20 to the cell 40 of the apparatus via pipes (not shown) connected to outlet 30. Situated upon tank top 22, in hydraulic connection with outlet 30, is fill pump 34. Fill pump 34 is a self-priming pump (preferably electrically powered) for pumping electrolyte from holding tank 20 through outlet 30 and upward into the electrolytic cell(s) 40,40',40" to be further described later. Fill pump 34 has a preferable rated discharge of at least seven gallons per minute (GPM) per cell.

Pipeline plumbing (not shown) from outlet 30 to the cell(s) 40 include flow meters (not shown) and valves (not shown) known in the art for monitoring and regulating the flow (e.g. at a consistent rate of 7 GPM) from holding tank 20 into each cell 40. In the preferred embodiment, such plumbing incorporates a valved bypass feature, to permit the flowmeters to be bypassed during the initial filling of cells 40,40',40"; flow from outlet 30 is monitored and controlled during the electroplating process after cells 40 have been filled with electrolyte and the electroplating process initiated. Additionally, the plumbing from outlet 30 preferably includes a three-way valve, such that the outlet plumbing may be used to drain holding tank 20.

As indicated by FIG. 8, the preferred embodiment of the invention contemplates the use of one to three electrolytic cells 40,40',40"; in the case of plural use, the electrolytic cells are substantially identical, and description herein of one cell 40 serves to describe each member of the plurality. Nevertheless, the invention may be practiced with a single cell, or, with obvious modification, more than three cells.

Reference is now made to FIGS. 1–7, showing various views of a preferred electrolytic cell 40 according to the invention. Each electrolytic cell 40 comprises cell container 42, which preferably is a hollow, oblong, rectangular container fashioned of, e.g. honeycombed fiberglass composite or other plastic, resistant to the corrosive effects of the electrolyte. Cell container 42 encloses cell chamber 48. Cell container 42 has a capacity of approximately 80 gallons in the preferred embodiment. Disposed upon the bottom of cell container 42 are mounting flanges 64,64' used to mount electrolytic cell 40 securely to holding tank 20, as described hereinabove.

Figure 5:
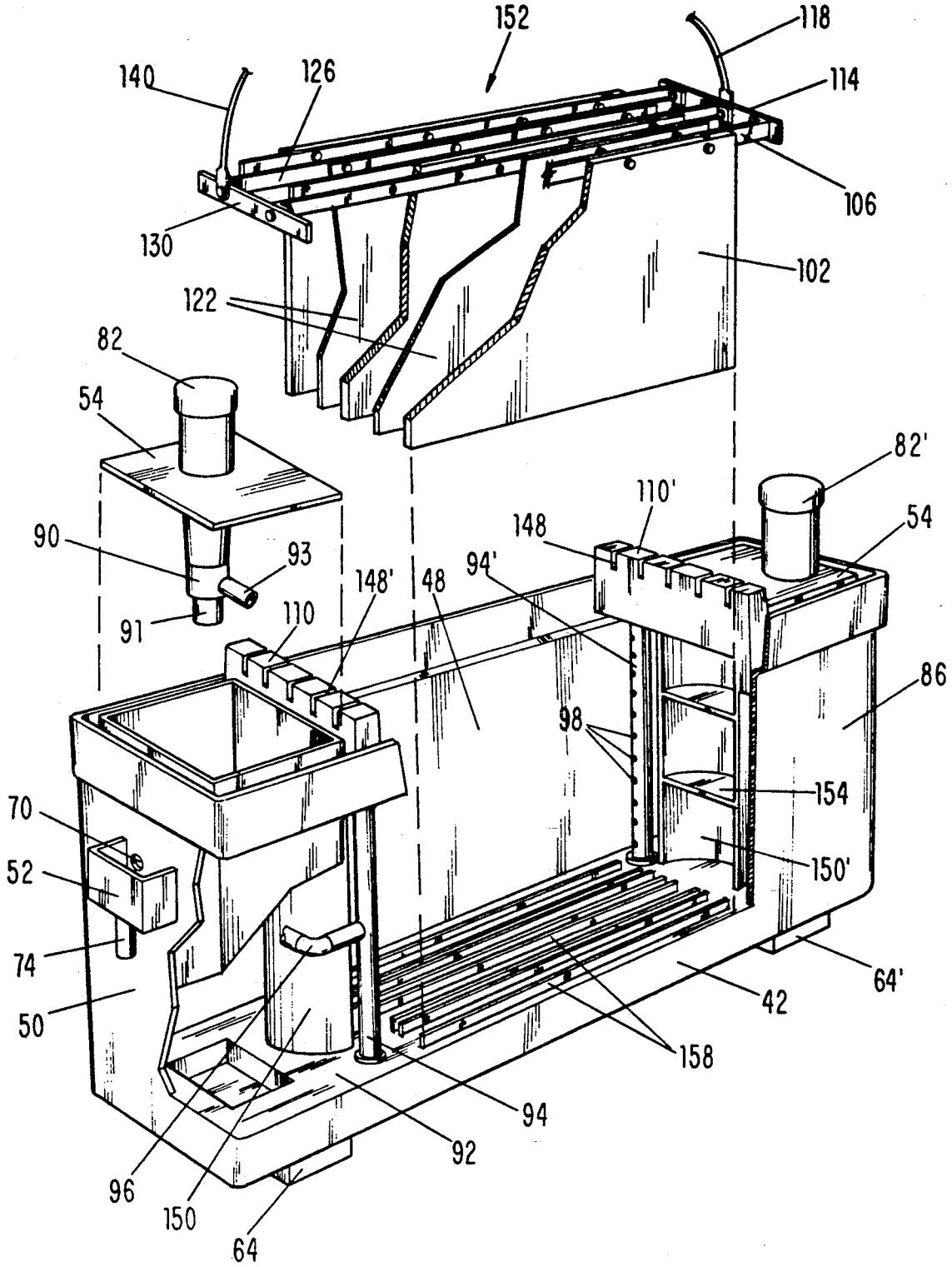
FIG. 5 is a an exploded perspective view of the front of the FIG. 1 embodiment, partially broken away to reveal certain internal features.

Attached to the exterior of left side 50 of cell container 42, somewhat below the cell top 54, is overflow drain 52. Overflow drain 52 is a boxlike structure having an open top and a drain hole 68 in its bottom. Overflow drain 52 is sealed to cell container 42 so as to be a leakproof container (excepting drain hole 68). As more clearly illustrated in FIG. 5, the precise location of overflow drain 52 is determined by the location of overflow weir 70 in cell container side 50. Overflow weir 70 is an opening completely penetrating the left side 50 of cell container 42; it is centered on the width of left side 50, a predetermined distance below cell top 54. Overflow weir 70 is of sufficient diameter or shape as to permit a minimum gravity flow rate equivalent to the pumping rate of pump 34 (shown in FIG. 8) (e.g. 7 GPM). As shown in FIG. 5, overflow drain 52 is so situated as to enclose overflow weir 70. Overflow drainpipe 74 is fitted to drain hole 68, permitting flow of electrolyte out of overflow drain 52. Overflow drainpipe 74 is fluidly connected (piping not shown) to overflow return inlet 28 illustrated in FIG. 8, such that electrolyte flowing from overflow drain 52 is returned to holding tank 20.

Each cell container 42 also includes a final drain (not shown) which is a discharge pump or valved orifice in floor 92 or lower side of cell container 42, permitting the cell 40 to be completely drained at the completion of a batch process cycle. At the end of a process cycle, the spent electrolytic solution is diverted from cells 40 to a separate tank (not shown) for additional treatment (e.g. filtering or carbon exchange) or disposal, and/or passed through an in-line filter in order to trap any solids in the electrolyte effluent. In the preferred embodiment, the final drain valve is a pump or three-way valve electronically connected to a master control panel 77 (shown in FIG. 10). Master control panel 77 includes microprocessor circuitry which signals the final drain valve to open upon completion of processing or failure of the power supply to the overall system; cell 40 thus drains upon completion of processing or emergency failure of power to the apparatus of the invention. Such a final drain allows the entire fluid contents of cell container 42 to be drained directly to holding tank 20 or other suitable container or processing (e.g. a filter trap).

Illustrated in FIGS. 2 and 4 are level limit switch 76 and electric panel 78, both of which are attached to the exterior of right side 80 of cell container 42. Junction box 78 may be centered on the width of right side 80.

Level limit switch 33 is located below top 22 of holding tank 20 at a height to permit total volume of 600 gallons. Limit switch 33, whose precise purpose will become clearer as the invention is further described, utilizes state-of-the-art technology to control the level of electrolyte in holding tank 20. It includes a sending unit (not shown) disposed within the wall of holding tank 20 so as to contact electrolyte within holding tank 20. When, as a result of pumping, electrolyte fills holding tank 20 to the height of level limit switch 33, it contacts the sending unit in level limit switch 33. Macroprocessor technology in level limit switch 33 then signals master control panel 77 (shown in FIG. 10) to terminate pumping (and thus discontinue additional filling of holding tank 20). Likewise, lower limit switch 35 can automatically indicate and provide for solution to be added to holding tank 20.

Figure 1:
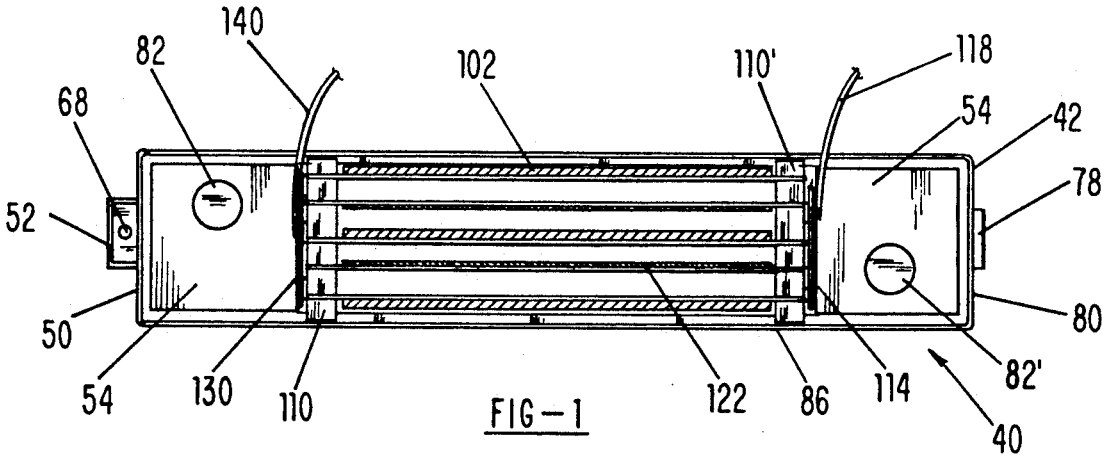
FIG. 1 is a plan view of the top of a single electrolytic cell according to the preferred embodiment of the invention.

Illustrated in FIGS. 1-4, and more particularly in FIG. 5 are two agitation pumps 82,82'. Agitation pumps 82,82' are high volume hydraulic pumps with rated discharges of preferably approximately 30 GPM for high velocity circulation. Agitation pumps 82,82' are attached to cell top 54 and are disposed near the right and left sides (50 and 80 respectively) of cell container 42, but have offset placements with respect to the front 86 of cell container 42. As indicated in FIG. 1, one agitation pump 82 is offset rearward from the center of the width of left side 50 and thus is nearer the back of cell container 42 than the front 86. Conversely, the opposing agitation pump 82' is situated nearer the front 86, for reasons to become more apparent hereinafter. The pumps and particular configuration of the apparatus of the invention provide a high velocity circulation with a high amount of turbulation for increased efficiency and recovery.

As shown in FIGS. 2 and 5, the housings of agitation pumps 82,82' are exteriorized through cell top 54 to permit the electrical components of the pumps to remain always above the level of electrolyte in the cell container 42. As shown in FIG. 5, the pump impellers 90 of agitation pumps 82,82' are located at a position within cell container 42 at about half the overall height of cell container 42. Pump impeller 90 includes an intake 91 at the bottom of the agitation pump apparatus 82,82' for intaking electrolyte from near the floor 92 of the cell. Impeller portion 90 also includes vent 93 fluidly connected to distributor tubes 94,94' via circulator pipes 96.

Reference is now made to FIG. 5. Distributor tubes 94,94' are perforated hollow tubes mounted vertically upon floor 92 of the cell. Distributor tubes 94,94' serve to distributively inject electrolyte into the cell chamber. As illustrated in FIG. 5, distributor tubes 94,94' are mounted vertically upon their longitudinal axes; both top and bottom of each distributor tube 94,94' are closed and sealed, such that electrolyte flows into distributor tubes 94,94' via circulator pipes 96 and exits through injection orifices 98. Injection orifices 98 consists of equally spaced, uniform diameter openings running vertically along the length of each distributor tube 94,94'. The total area of orifices 98 should be approximately 75% of the total cross-sectional area of the inner diameter of the circulator pipes 96 to produce more equal flow from each. Shown in FIG. 5 are the offset locations of distributor tubes 94,94'. It is noted that the distributor tubes 94,94' are placed at offset locations opposite their respective agitation pumps 82,82'. Where agitation pump 82 is offset toward the back of cell container 42, its associated distributor tube 94 is offset toward the cell front 86. The agitation pump 82' and distributor tube 94' at the opposite side of the cell 40 have a reversed configuration. This configuration effectively draws solution from the cell interior to provide solution for the distributor tubes 94,94'.

Also illustrated in FIG. 5 are two flow deflectors 150,150', used to direct the flow of electrolyte through the electrode assembly shown at 152. Flow deflectors 150,150' are semicylindrical surfaces mounted vertically above the floor 92, near the respective sides of cell container 42, to allow for fluid return to the pump section. The interior concave surfaces of flow deflectors 150,150' oppose each other since the concave surfaces face toward the inside of cell container 42. It can be observed in FIG. 5 that flow deflectors 150,150', like agitation pumps 82,82', have locations offset toward front 86 and back of cell container 40, respectively. Flow deflectors 150,150' are fitted with horizontal baffles 154, such that flow deflectors 150,150' alter mainly the horizontal, rather than vertical, direction of electrolyte flow.

Figure 6:
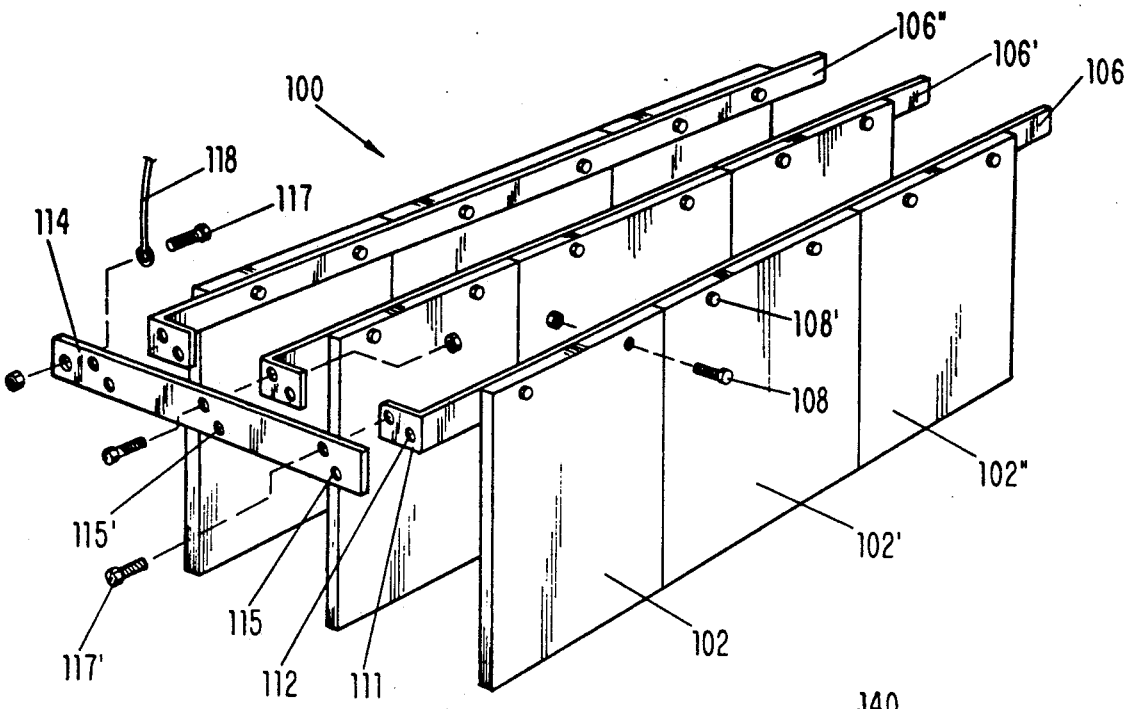
FIG. 6 is a perspective view of the anode plate assembly according to the preferred embodiment of the invention.

Reference is now made to FIG. 6, illustrating the preferred construction of anode assembly 100. Anode assembly 100 preferably comprises sets of anode plates 102,102',102". Anode plates 102,102',102" preferably are composed of graphite, but may be composed of other conductive materials known to the art and effective for particular plating applications. In the preferred embodiment, each electrolytic cell 40 utilizes three groups of anode plates, each group in turn preferably comprising three anode plates 102,102',102". Each trio of plates is suspended from a corresponding anode plate hanger 106,106',106" composed of nickel plated copper or other corrosion-resistant conductive material. Anode plates 102,102',102" are mounted to an anode plate hanger 106 with typical nut and bolt assemblies 108,108'. As stated, in the preferred embodiment, three graphite plates 102,102',102", are mounted to each anode plate hanger 106; alternatively, a single, large plate of anode or other suitable material could be similarly mounted to each anode plate hanger 106. Aligning three smaller anode plates 102,102',102", upon each anode plate hanger 106, however, facilitates manipulation and maintenance of the anode assembly 100

As mentioned, anode plate hangers 106,106',106" are composed of electrically conductive material, and are shaped as long flattened bars. Anode plate hangers 106,106',106" are of sufficient length to extend some distance beyond the outside edges of anode plates 102,102',102" in order to facilitate the insertion of anode plate hangers 106, into notches on the plate hanger supports 110,110' illustrated in FIG. 5. Referring still to FIG. 6, it is observed that each anode plate hanger 106,106,106" is electrically connected to anode bus bar 114, which is composed of conductive material. One end of each anode plate hanger 106,106,106" is bent at a right angle 111 and pierced with a bolt hole 112. Corresponding holes 115,115' are drilled in anode bus bar 114, permitting electrically conductive anode nut/bolt combinations 117,117' to securely fasten bus bar 114 to anode plate hangers 106,106',106". Importantly, the connection between anode bus bar 114 and anode plate hangers 106,106',106" is electrically conductive; FIG. 6 shows the use of one anode nut/bolt combination 117 to electrically connect anode rectifier lead 118 to bus bar 114. Rectifier lead 118 is insulated wire leading to the rectifier device 142 illustrated in FIG. 9.

Figure 7:
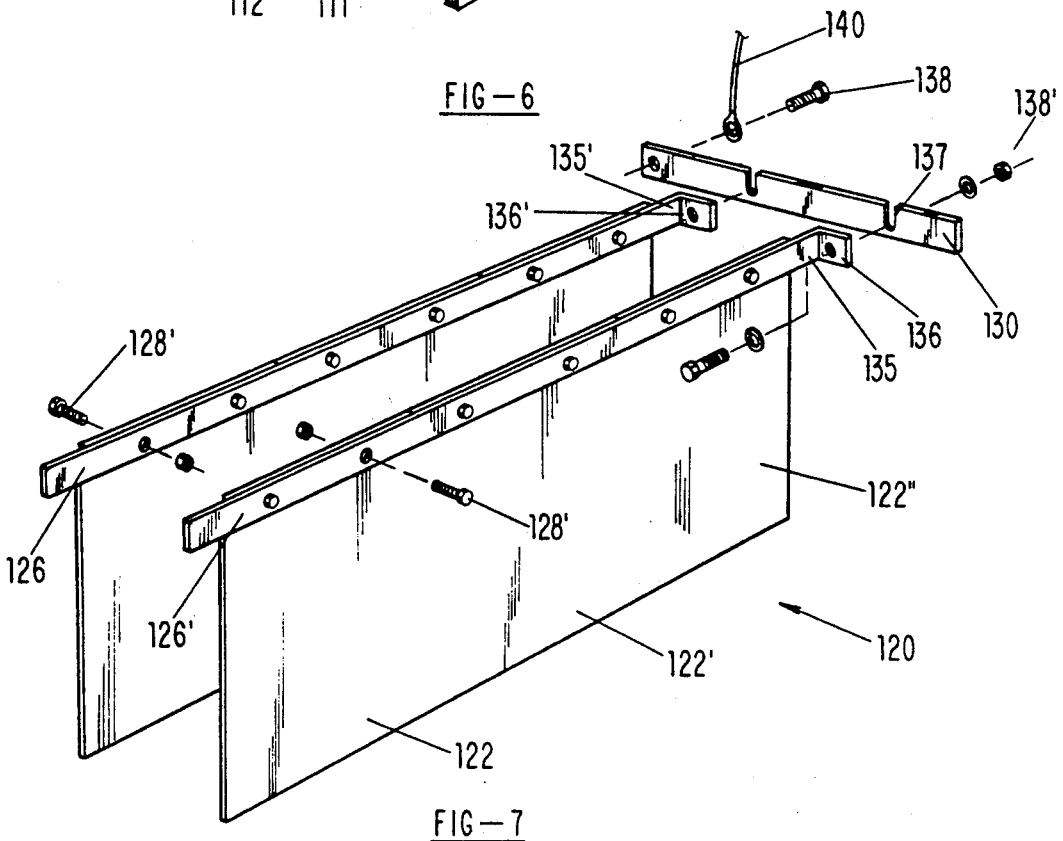
FIG. 7 is a perspective view of the cathode plate assembly according to the preferred embodiment of the invention.

Reference is now made to FIG. 7, illustrating cathode assembly 120. In the preferred embodiment, the cathode assembly 120 comprises two sets of stainless steel cathode plates 122,122' securely and electrically connected to cathode plate hangers 126,126', using nut/bolt assemblies 128,128'. Cathode plates 122 alternatively may be composed of other suitable material known in the art. In the preferred embodiment, cathode plates 122 are a single plate; alternatively, as with the anode assembly 100, sets of cathode plates may be attached to each cathode plate hanger 126. Cathode plate hangers 126,126' are of extended length to allow their ends to rest into the insulated notches of plate hanger supports 110,110' shown in FIG. 5. Electrically conductive cathode bus bar 130 is electrically attached to cathode plate hangers 126,126 in an identical fashion as described for anode assembly 100, i.e., using right-angle bends 135,135' and bolt holes 136,136' in cathode plate hangers 126,126' in conjunction with aligned holes 137,137' in cathode bus bar 130, the elements secured with cathode nut/bolt combinations 138,138'. One nut/bolt combination 138 also electrically connects cathode rectifier lead 140 to the cathode bus bar 130.

Taken together, FIGS. 5-7 suggest the positional relationship between anode assembly 100 and cathode assembly 120. Anode bus bar 114 is at the left end of anode assembly 100, while cathode bus bar 130 is attached to the opposite (right) ends of the cathode plate hangers 126,126'. These positional relationships allow the cathode plates 122 to be inserted between the anode plates of anode assembly 100, such that the two cathode plates 122 are sandwiched between the three anode plates 102. When so parallelly interpositioned, the electrode assemblies can be set into their corresponding support notches 148,148' in plate hanger supports 110,110', as shown in FIG. 5. Also best illustrated in FIG. 5 are the relative sizes of anode plates 102,102' and cathode plates 122; the electrode plates are of equal perimeter dimensions, such that opposing faces of adjacent plates comprise approximately equal surface areas. This 1:1 ratio of anode to cathode surface area is preferred, however other ratios may be utilized in accordance with the invention. This anode/cathode ratio of 1:1 increases the plating action per current density factor.

When properly interpositioned, anode assembly 100 and cathode assembly 120 in combination comprise electrode assembly 152 shown in FIG. 5. Electrode assembly 152 thus consists of cathode plates 122 alternatively "sandwiched" between anode plates 102. The entire electrode assembly 152 is lowered into cell chamber 48 and is suspended therein; support for electrode assembly 152 is provided by removably disposing the ends of anode plate hangers 106 and cathode plate hangers 126 into corresponding notches in plate hanger supports 110,110' mounted on cell top 54. In the preferred embodiment, plate tracks 158 on floor 92 provide positional guidance and support for the bottom edges of electrode assembly 152. A top view of the preferred embodiment of the electrolytic cell of the apparatus, with electrode assembly 152 installed, is provided in FIG. 1.

Figure 9:
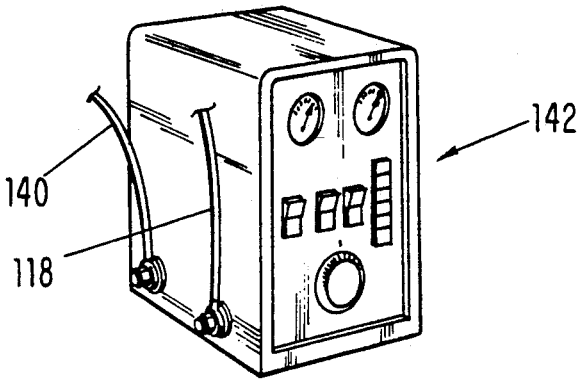
FIG. 9 is a perspective view of the electronic rectifier according to the preferred embodiment of the apparatus.

FIG. 9 shows the electronic rectifier 142 of the invention. Rectifier 142 is constructed generally in accordance with principles known to the art, e.g. rectifier 142 comprises electronic components for providing constant direct current to electrode assembly 152; anode plates 102 are charged positively and cathode plates 122 are charged negatively via anode rectifier lead 118 and cathode rectifier lead 140, respectively. Rectifier is of a sufficient size to supply a minimum of 15 amperes direct current per square foot of wetted cathode surface, and, accordingly, may vary in size according to the size of cathode plates 122. In the preferred embodiment rectifier 142 is of a sufficient size to provide a minimum of 15 DC amps per square foot of cathode wetted surface, with provisions for either constant current or constant voltage and a highly filtered output with minimum ripple in the DC current (e.g. a ripple factor of 5% or less). One rectifier 142 is preferably used for a plurality of electrolytic cells 40.

Figure 10:
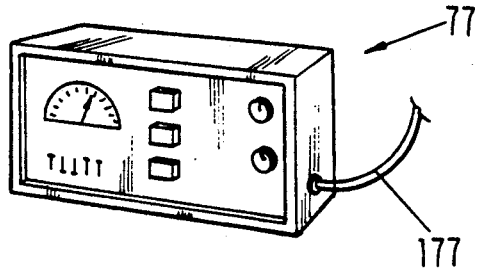
FIG. 10 is a perspective view of the control panel according to the preferred embodiment of the apparatus.

Reference is now made to FIG. 10, depicting the master control panel 77. Master control panel 77 is an electronic device electrically connected, via control lead 177, to electric panel 78 and to level limit switches 76. As previously mentioned, master control panel 77 contains microprocessing elements, known in the electronic art, for processing signals from level limit switch 76, shown in FIG. 2. When sufficient electrolyte is pumped from holding tank 20 into cell container(s) 42 to reach the height of level limit switch(s) 76, level limit switch signals such information to master control panel 77, which processes the information and in turn signals a macroprocessor in electric panel 78. Electric panel 78 is electrically connected to fill pump 34, such that upon receipt of the appropriate signal from master control panel 77 that cell container 42 is full, the macroprocessor in electric panel 78 directs agitation pumps 82,82' and rectifier to turn on.

Figure 11:
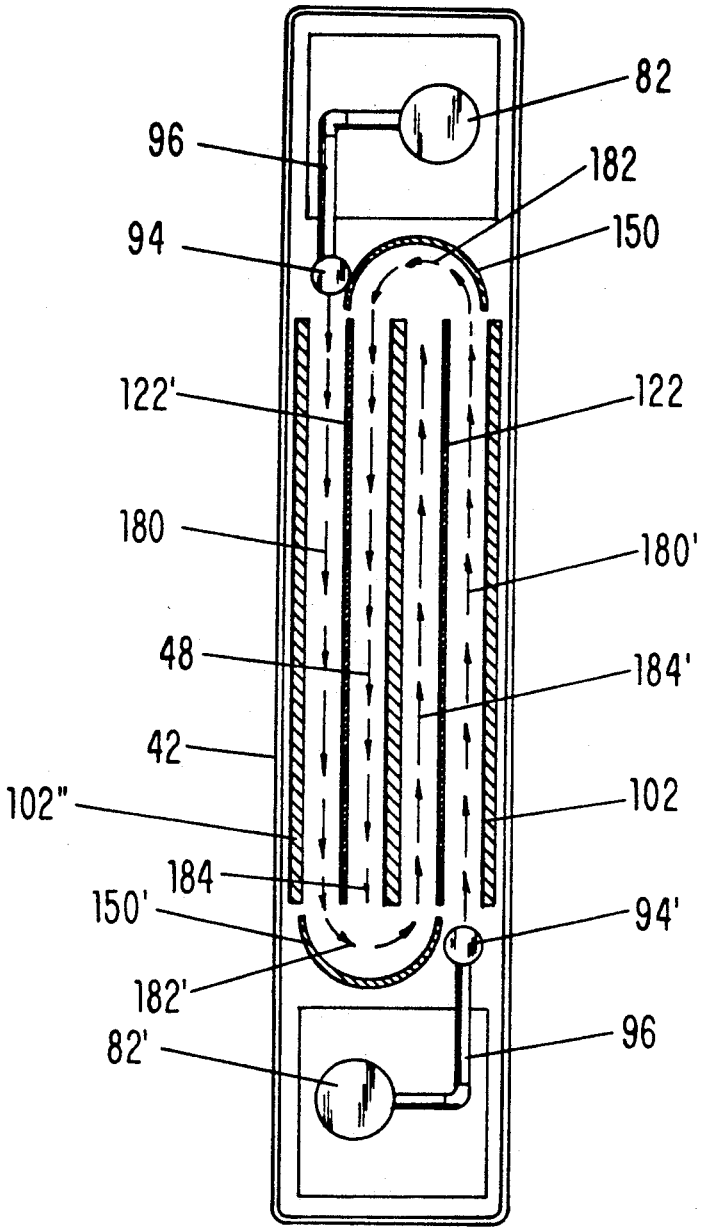
FIG. 11 is a plan view of the flow pattern of electrolyte through the apparatus of the invention.

FIGS. 5 and 11 together illustrate the unique and advantageous pattern of solution flow within cell chamber 48. Electrolyte solution is pumped from the bottom of cell chamber 48 by agitation pumps 82,82' via agitation pump intake 91. The solution is forced by agitation pump impeller 90 through vent 93 and circulator pipe 96 and into distributor tubes 94,94'. Under pressure, the solution is injected into cell chamber 48 via injection orifices 98 in distributor tubes 98,98'. The solution is then within cell chamber 48, and thus available to reenter agitation pump intake 91, and the process is repeated. A single batch of solution may thus be recirculated through the cell 40 any number of times during the course of the recovery treatment.

With particular reference to FIG. 11, it is seen that the injection of solution from distributor tubes 98,98' causes solution to flow parallelly between outside anode plates 102' and 102" and cathode plates 122, as indicated by flow arrows 180,180'. While the solution thus flows, metal is deposited upon the outside surfaces (opposite from outside anode plates 102',102") of cathode plates 122,122'. Under continued inertial flow, the solution is deflected by flow deflectors 150,150', where its direction of flow is reversed 180 degrees, as indicated by flow arrows 182,182'. Solution flow then continues parallelly between cathode plates 122,122' and central anode plate 102, as indicated by flow arrows 184,184'. While the solution is thus flowing, metal is deposited upon the inside surfaces (opposite central anode plate 102) of cathode plates 122,122'. It is thus noted that with continued operation of agitation pumps 82,82', an equilibrium of solution flow is established along flow lines 180,180',182,182' and 184,184'. This "racetrack" pattern of flow results in an increased diffusion rate of metal ions from the solution and onto the four surfaces of cathode plates 122,122', thereby enhancing recovery.

Additionally, when master control panel 77 has received the signal from holding tank level limit switch that holding tank 20 has been filled to the proper level, microprocessors in master control panel 77 send a corresponding electronic signal to electric panel 78, which is electrically connected to fill pump 34 which fills the electrolytic cells 40. After cells 40 are filled, master control panel 77 actuates and turns on agitation pumps 82,82' and rectifier 142 to commence processing. Alternatively, master control panel 77 can be programmed electronically to "lock out" or prohibit a manual start of agitation pumps 82,82' when holding tank is insufficiently filled with electrolyte. Fill pump 34 continues to pump solution from holding tank 20 to cells 40 which overflow back to holding tank 20.

Master control panel 77 also contains timing devices known in the art. When, in response to the appropriate signal from plating cell level limit switches, agitation pumps 82,82' are actuated by master control panel 77 and begin processing by circulating electrolyte through cell 40, master control panel 77 monitors the elapsed time from commencement of processing. Using master control panel 77, a user can preset a desired total plating time. Master control panel 77 includes a digital chronometer that, like an alarm clock, monitors elapsed time and can be preprogrammed to send electronic signals at one or more predetermined times. When the desired processing time has elapsed, control panel 77 signals agitation pumps 82,82' to shut off and the final drain valve in the cell 40 to open. Process parameters, such as pH, bath temperature, and process chemistry, may be monitored and controlled via master control panel 77. For instance, if the solution pH strays outside predetermined limits, acid-or base-producing chemicals may be introduced into the solution automatically until the pH reaches the desired limit. Likewise, if the bath temperature drops below a certain level, master control panel can initiate a heater present in the electrolytic cell. Heaters, pH meters, additive feeders, and the like, are not shown in the drawings. As can be appreciated by those skilled in the art, master control panel 77 may be utilized to control most desired process parameters. In summary, the master control panel 77 controls, by operating various pumps, the fill plating and dump cycles and flow rates, as well as additives by timed outputs, limit switches, and set process control parameters. In addition, master control panel 77 and associated hardware, monitors the level of solutions in the supply, discharge and process tanks and within the individual plating cells; initiates the process cycle automatically when sufficient solution is available or allows manual starting when sufficient solution is present in the electrolytic cells; controls the time of the process; provides a timed AC output for the operation of one or more pumps or feeders for the addition of liquid or solid compounds to the electrolytic cells for pH adjustment or sulfite addition or for any other chemical adjustment necessary or desirable; allows for more than one plating voltage or current at different times during the plating cycle; and does not allow the process to start unless there is enough space in the discharge tank to hold the total discharge from the electrolytic cells. Other automatic or manual monitoring and control may be set by or provided to master control panel 77.

In the preferred embodiment, master control panel 77 provides for either stepped voltage or stepped amperage. For example, it may be desirable to run the batch process at an initial, higher voltage for a predetermined time, and at a subsequent, lower voltage for an additional predetermined time. Likewise, the amperage can be set higher for an initial period and reduced for a subsequent processing period. As can be appreciated by those skilled in the art, the voltage or amperage can be changed once or several times, or as a result of detected or monitored process parameters (e.g. buildup of metal on the cathodes, bath temperature, pH, etc.). Changes in the voltage or amperage can occur automatically as set via master control panel 77 or in response to process conditions. The rectifier 142 has the capability of utilizing either a constant current or constant voltage.

With reference to the foregoing description of the apparatus, the method of the invention may be summarized. Master control panel 77 is preprogrammed with a desired processing time. Additionally, the master control panel 77 is preprogrammed, if desired, to send electronic signals to trigger the addition of solution additives (e.g. NaOH or sulfites) and/or a change in plating voltage or current. The number of cells 40 to be utilized is determined. An electrode assembly 152 is assembled for each cell 40 (in the preferred embodiment numbering one to three) to be utilized. Anode rectifier lead 118 and cathode rectifier lead 140 are electrically attached to anode bus bar 114 and cathode bus bar 130, respectively, of each electrode assembly 152. An electrode assembly 152 is lowered into each cell container to utilized. The cells 40,40',40" to be used are lifted atop holding tank 20, sliding mounting flanges 64 in between cell support brackets 60. Necessary plumbing is connected, particularly the piping from holding tank outlet 30 to cell container 42, and the piping from overflow drainpipe 74 to overflow return inlet 28 in holding tank 20.

Rectifier 142 is preset to the desired amperage or voltage. All valves permitting drainage from the cell containers 42 and holding tank 20 are closed. The electrolytic solution to be processed is pumped into holding tank 20, until the level of electrolyte reaches the level of holding tank level limit switch. When holding tank level limit switch detects the level of electrolyte in holding tank 20, the master control panel 77 is so signaled. Microprocessor circuitry in master control panel 77 then directs the discontinuation of further filling of holding tank 20, and simultaneously activates fill pump 34.

Electrolyte is pumped by fill pump 34 from holding tank 20 via outlet 30 and into cell container 42. Cell container 42 (and thus cell chamber 48) is filled with electrolyte solution, which solution surrounds anode plates 102 and cathode plates 122,122' suspended from anode plate hangers 106,106' and cathode plate hangers 126,126'. Pumping by fill pump 34 is continued, filling cell chamber 48 to the level of level limit switch 76. When electrolyte attains the level of level limit switch 76, sending unit in level limit switch 76 triggers electronic signal via control lead 177 to master control panel 77. The signal passes via master control panel 77 to agitation pumps 82,82'. Direct current is applied to anode assembly 100 and cathode assembly 120 by rectifier 142. Throughout the filling of cell container(s) 42 and the operation of agitation pumps 82,82', excess electrolyte in cell container 42 is permitted to discharge through overflow weir 70, whereupon the excess is returned to holding tank 20 via overflow drain 52, overflow drainpipe 74 and piping therefrom to overflow return inlet 28.

As the electrolytic solution flows past cathode plates 122, following a recirculating flow pattern described hereinabove, metal ions from the solution are electroplated upon both surfaces of cathode plates 122. During the electroplating sequence, timed signals from master control panel 77 may direct the addition of additives based on processing parameters. Additives typically include compounds for improving or maintaining the pH, conductivity, and other electrolytic or chemical properties of the circulating solution. Also, during the electroplating process, manual or timed signals from master control panel 77 adjust the voltage or amperage from the rectifier 142 to the electrode assembly 152.

After the electroplating process has continued for the predetermined length of time, a timed signal is sent from master control panel 77 to electric panel 78 directing agitation pumps 82,82' and rectifier to shut down. Concurrently, an electronic signal may be sent to final system drain valves, instructing them to open and drain the electrolyte from the system for disposal or further treatment.

The invention is particularly suitable for precious metals recovery from solutions. For example, silver may be recovered from photographic fixer solutions for the purposes of reclamation and pollution abatement.

The cathodes are periodically stripped to recover the metal plated thereon. This is generally done after several batch processes through each electrolytic cell. To strip the cathodes, an operator removes the cathodes from the cells, scrapes the cathodes, and then repositions the cathodes back into the electrolytic cells for subsequent batch processing.

The apparatus and process of the invention provide for improved efficiency and productivity in metals recovery by an anode/cathode ratio of 1:1 thereby increasing the plating action per current density factor; assures extremely rapid replacement of the solution in contact with the cathode, insuring fresh solution for plating at all times by providing very high circulation of the solution of the plating cell; allows the choice of constant current or constant voltage, whichever is most applicable to the particular metal-bearing solution; reduces maintenance time because of reduced moving parts in comparison to prior art devices (e.g. rotating cathodes); utilizes automated controls that do not require operator involvement; and results in reduced effort in stripping the cathodes due to the nature of the plated material and the flat cathode design.

EXAMPLE

Two electrolytic cells having a volume of 80 gallons each were positioned atop a holding tank having a volume of 600 gallons. The holding tank was filled with waste solution containing 2800 ppm silver by volume from a photographic process. After the holding tank was filled with the silver-bearing solution, thereby hitting a limit switch and activating a pump, the solution was pumped at a rate of 7 GPM into each of the electrolytic cells for batch processing.

Each electrolytic cell contained three anodes made of graphite and two cathodes made of stainless steel. The cathode plates were sandwiched between the anode plates, so that there were alternating plates as follows in each electrolytic cell: anode/cathode/anode/cathode/anode. A common rectifier provided power to both electrolytic cells.

After both electrolytic cells were filled with the solution from the holding tank, circulation pumps were automatically activated, current was provided to the anodes, and the batch silver process was initiated. Flow meters controlled the circulation flow to 7 GPM through the tanks. Automatic controls provided a voltage of 2.2 volts for 9 hours. The voltage was a constant. The amperage fluctuated. The pH was adjusted to 8.3 by adding NaOH at the beginning of the process via an automatic timed feed pump.

After completing the batch process in 9 hours, the electrolytic cells were emptied. The spent solution contained approximately 50 ppm silver by volume.

The above process was repeated 6 times to allow a sufficient buildup of silver on the cathodes. The cathodes were then lifted from the electrolytic cells and the silver deposit scraped from the cathodes. The cathodes were then positioned back in the electrolytic cells for use in subsequent silver recovery processed.

Although the invention has been described with reference to these preferred embodiments, other embodiments can achieve the same results. Variations and modifications of the present invention will be obvious to those skilled in the art and it is intended to cover in the appended claims all such modifications and equivalents. The entire disclosures of all applications, patents, and publications cited above, and the corresponding application are hereby incorporated by reference.

What is claimed is:

1. An electrolytic plating apparatus for recovering metals from an electrolytic solution, comprising:

at least one walled cell container comprising at least two sides;

electronic rectifier means;

at least two outside anode means parallelly disposed within said container;

at least one central anode means comprising two surfaces, parallelly disposed between said outside anode means;

at least two cathode means parallelly and alternately disposed between said central anode means and said outside anode means;

at least two means for horizontally circulating by pressurized injection said electrolytic solution around said central anode means and between said central anode means and said cathode means, while simultaneously circulating by pressurized injection said solution parallelly between said cathode means and said outside anode means, wherein said circulating means are disposed at opposite sides of said walled cell container and proximately to an end of each said outside anode means; and means for deflecting the horizontal circulation of said solution circuitously about said central anode means, whereby the circulation of said fluid is in opposite directions, respectively, across said surfaces.

2. An apparatus in accordance with claim 1 wherein said cell container comprises a rectangular-shaped box.

3. An apparatus in accordance with claim 1 wherein said outside anode means comprise plates mounted adjacent to walls of said cell container.

4. An apparatus in accordance with claim 1 wherein said central anode means comprises at least one plate equidistantly mounted between said outside anode means.

5. An apparatus in accordance with claim 1 wherein said cathode means comprises plates equidistantly mounted between said central anode means and said outside anode means.

6. An apparatus in accordance with claim 1 wherein said means for horizontally circulating by pressurized injection comprises perforated tubes disposed within said cell container and connected to a fluid pump.

7. An apparatus in accordance with claim 6 wherein said perforated tube comprises vertically mounted tube perforated along its length with a single row of regularly-spaced injection outlets.

8. An apparatus in accordance with claim 7 wherein said injection outlets comprise injection outlets directionally aimed at the space between one said outside anode means and one said cathode means.

9. An apparatus in accordance with claim 1 wherein said deflection means comprises at least two semicylindrical deflectors vertically disposed within said cell container.

10. An apparatus in accordance with claim 1 further comprising means for removably stacking at least one said cell container atop a holding tank.

11. An apparatus in accordance with claim 10 wherein said holding tank comprises a width at least as wide as the combined width of two horizontally adjacently disposed cell containers.

12. An apparatus in accordance with claim 10 wherein said stacking means comprises support rails attached to said holding tank and corresponding mounting flanges attached to said cell containers for slideable insertion into said support rails.

13. An apparatus in accordance with claim 10 wherein said electronic rectifier means is connected to a plurality of cells stacked atop said holding tank.

14. An apparatus in accordance with claim 1 further comprising electronic signalling means, in said cell container, for detecting at least one process parameter selected from the group consisting of solution level, bath temperature, bath pH, flow rate, and solution chemistry.

15. An apparatus in accordance with claim 14 wherein said signalling means further comprises means for electronically switching a pump.

16. An electrolytic plating apparatus comprising:

a holding tank;

a plurality of separate electrolytic cell means removably mounted atop said holding tank, each said cell means comprising a cell chamber enclosed within a cell container; and means for providing electrolyte flow directly between said holding tank and each of said separate electrolytic cell means.

17. An apparatus in accordance with claim 16 wherein said holding tank comprises a capacity of at least 200% of the total volume of said plurality of electrolytic cell means.

18. An apparatus in accordance with claim 16 wherein said holding tank further comprises support means for said plurality of electrolytic cell means.

19. An apparatus in accordance with claim 18 wherein said support means comprises a plurality of paired brackets.

20. An apparatus in accordance with claim 19 wherein said plurality of electrolytic cell means comprises a plurality of mounting flange means for engaging said plurality of paired brackets.

21. An apparatus in accordance with claim 16 wherein said means for providing electrolyte flow comprises pump means.

22. An apparatus in accordance with claim 16 wherein said means for providing electrolyte flow comprises overflow means.

23. An apparatus in accordance with claim 16 wherein said means for providing electrolyte flow further comprises means for regulating electrolyte flow.

24. An apparatus in accordance with claim 23 wherein said means for regulating electrolyte flow further comprise means for monitoring electrolyte flow.

25. An apparatus in accordance with claim 16 further comprising common rectifier means for said electrolytic cell means.

26. A system for controlling an electroplating process comprising:

a plurality of electrolytic cell means;

anode means and cathode means disposed within each said cell means;

means for automatically controlling flow of electrolyte in and from said electrolytic cell means; and common rectifier means in connection with said anode means and cathode means.

27. A system in accordance with claim 26 wherein said means for automatically controlling flow of electrolyte comprises limit switch means.

28. A system in accordance with claim 26 wherein said means for automatically controlling flow of electrolyte further comprises microprocessor means.

29. A system in accordance with claim 28 wherein said microprocessor means further controls at least one electroplating process parameter selected form the group consisting of solution levels, bath temperatures, bath pH, flow rates and solution chemistry.

30. A system in accordance with claim 26 wherein said means for automatically controlling flow of electrolyte further comprises means for controlling the fill, plating and drain cycles of said plurality of electrolytic cell means.

31. A system in accordance with claim 26 further comprising holding tank means disposed below said electrolytic cell means.

32. A method for electrolytic recovery of metals from solution, the method comprising the steps of:

a) filling at least one electrolytic cell with the solution from a holding tank;

b) determining when the level of solution in the cell attains a height;

c) automatically commencing circulation of the solution within the cell when the level of solution attains the height;

d) allowing the solution to overflow the cell and return to the holding tank while simultaneously continuing to pump the solution from the holding tank to the electrolytic cell;

e) timing the duration of solution circulation;

f) automatically discontinuing the circulation of the solution in the cell after a period of time; and g) automatically draining the solution from the cell.

33. The method of claim 32 wherein the step of determining when the level of solution in the cell attains a height comprises the step of the solution reaching a level limit switch upon the cell wall which sends an electronic signal when contacted by the solution.

34. The method of claim 32 wherein the step of automatically commencing circulation comprises the step of microprocessing the signal from the level limit switch and sending a resulting process signal to an agitation pump.

35. The method of claim 32 wherein the step of timing the duration of solution circulation comprises the step of utilizing chronometer means.

36. The method of claim 32 wherein the step of automatically discontinuing the circulation of solution comprises the step of programming the chronometer means to send a signal to an agitation pump after a period of total circulation time has elapsed.

37. The method of claim 36 wherein the step of determining when the level of solution in the cell attains a height comprises the step of the solution reaching a level limit switch upon the cell wall which sends an electronic signal when contacted by the solution.

38. The method of claim 37 wherein the step of utilizing chronometer means comprises programming the chronometer means to send a signal to an electromechanical valve or pump after a period of time has elapsed.

39. The method of claim 32 further comprising the additional step of automatically adding additives to the solution.

40. The method of claim 39 wherein the step of automatically adding additives to the solution comprises the step of programming chronometer means to send at least one electronic signal to at least one additive feeding device after at least one period of time has elapsed.

41. The method of claim 39 wherein the step of automatically adding additives to the solution comprises the step of monitoring the solution chemistry or pH and sending at least one signal to at least one additive feeding device when a change in solution chemistry is detected.

42. The method of claim 32 further comprising the step of providing a stepped amperage during the circulation of the solution within the electrolytic cell.

43. The method of claim 42 wherein the step of automatically adjusting the amperage comprises the step of programming chronometer means to send at least one signal to an amperage regulator after at least one period of time has elapsed.

44. The method of claim 32 further comprising the step of providing a stepped voltage during the circulation of the solution within the electrolytic cell.

45. The method of claim 44 wherein the step of automatically adjusting the voltage comprises the step of programming chronometer means to send at least one signal to a voltage regulator after at least one period of time has elapsed.

46. A method for electrolytic recovery of metals from a solution, the method comprising the steps of:

a) filling at least one electrolytic cell with solution;

b) providing a constant current or a constant voltage to the cell; and c) automatically varying the current or the voltage, whichever is the constant, by programming chronometer means to send a signal to a current regulator or to a voltage regulator after at least one period of time has elapsed.

47. An apparatus for electrolytic recovery of metals from solution, the apparatus comprising:

at least one electrolytic cell;

a holding tank;

means for filling said electrolytic cell with the solution from said holding tank;

means for determining when the level of solution in said cell attains a predetermined level;

means for automatically commencing circulation of the solution within said cell when the level of solution attains said predetermined level;

means for overflowing the solution from said electrolytic cell to said holding tank while simultaneously continuing to pump the solution from said holding tank to said electrolytic cell;

means for timing the duration of solution circulation;

means for automatically discontinuing the circulation of the solution in said cell at a predetermined time; and means for automatically draining the solution from said cell.

48. The apparatus of claim 47 wherein said means for determining when the level of solution in said cell attains a predetermined level comprises a level limit switch upon the cell wall which sends an electronic signal when contacted by the solution.

49. The apparatus of claim 47 wherein said means for automatically commencing circulation comprises microprocessing means for microprocessing a signal from said level limit switch and sending a resulting process signal to agitation pump means.

50. The apparatus of claim 47 wherein said means for timing the duration of solution circulation comprises chronometer means.

51. The apparatus of claim 47 wherein said means for automatically discontinuing the circulation of solution comprises chronometer means for sending a signal to an agitation pump after a predetermined period of total circulation time has elapsed.

52. The apparatus of claim 47 wherein said means for automatically draining the solution from said cell comprises chronometer means.

53. The apparatus of claim 52 wherein said chronometer means comprises programmed chronometer means sending a signal to an electromechanical valve or pump after a predetermined period of time has elapsed.

54. The apparatus of claim 47 further comprising means for automatically adding additives to the solution.

55. The apparatus of claim 54 wherein said means for automatically adding additives to the solution comprises programmed chronometer means to send at least one electronic signal to at least one additive feeding device after at least one predetermined period of time has elapsed.

56. The apparatus of claim 54 wherein said means for automatically adding additives to the solution comprises means for monitoring the solution chemistry or pH and sending at least one signal to at least one additive feeding device when a change in solution chemistry is detected.

57. The apparatus of claim 47 further comprising means for adjusting the amperage at predetermined times during the circulation of the solution within said electrolytic cell.

58. The apparatus of claim 53 further comprising means for adjusting the voltage, said means comprising programmed chronometer means for sending at least one signal to a voltage regulator after at least one predetermined period of time has elapsed.

59. The apparatus of claim 47 further comprising means for providing a constant voltage at predetermined times during the circulation of the solution within said electrolytic cell.

60. The apparatus of claim 57 wherein said means for adjusting the amperage comprises programmed chronometer means for sending at least one signal to an amperage regulator after at lest one predetermined period of time has elapsed.

61. An apparatus for electrolytic recovery of metals form a solution, the apparatus comprising:

means for filling at least one electrolytic cell with solution;

means for providing a constant current or a constant voltage to said cell; and means for automatically varying said current or said voltage, whichever is the constant, said varying means comprising programmed chronometer means to send a signal to a current regulator or to a voltage regulator after at least one period of time has elapsed.

62. An electrolytic plating apparatus for recovering metals from an electrolytic solution, comprising:

at least one walled cell container;

electronic rectifier means;

at least two outside anode means parallelly disposed within said container;

at least one central anode means comprising two surfaces, parallelly disposed between said outside anode means;

at least two cathode means parallelly and alternately disposed between said central anode means and said outside anode means;

pressurized solution injection means for horizontally circulating said electrolytic solution around said central anode means and between said central anode means and said cathode means, while simultaneously circulating said solution between said cathode means and said outside anode means, wherein said pressurized solution injection means for circulating comprises at least one perforated tube disposed within said cell container and connected to a fluid pump; and means for deflecting the horizontal circulation of said solution circuitously about said central anode means, whereby the circulation of said fluid is in opposite directions, respectively, across said surfaces.

63. An apparatus in accordance with claim 62 wherein said perforated tube comprises vertically mounted tube perforated along its length with a single row of regularly-spaced injection outlets.

64. An apparatus in accordance with claim 63 wherein said injection outlets comprise injection outlets directionally aimed at the space between one said outside anode means and one said cathode means.

65. An electrolytic plating apparatus for recovering metals from an electrolytic solution, comprising:

at least one walled cell container;

means for removably stacking at least one said cell container atop a holding tank;

electronic rectifier means;

at least two outside anode means parallelly disposed within said container;

at least one central anode means comprising two surfaces, parallelly disposed between said outside anode means;

at least two cathode means parallelly and alternately disposed between said central anode means and said outside anode means;

means for horizontally circulating said electrolytic solution around said central anode means and between said central anode means and said cathode means, while simultaneously circulating said solution between said cathode means and said outside anode means; and means for deflecting the horizontal circulation of said solution circuitously about said central anode means, whereby the circulation of said fluid is in opposite directions, respectively, across said surfaces.

66. An apparatus in accordance with claim 65 wherein said holding tank comprises a width at least as wide as the combined width of two horizontally adjacently disposed cell containers.

67. An apparatus in accordance with claim 65 wherein said stacking means comprises support rails attached to said holding tank and corresponding mounting flanges attached to said cell containers for slidable insertion into said support rails.

68. An apparatus in accordance with claim 65 wherein said electronic rectifier means is connected to a plurality of cells stacked atop said holding tank.

69. An electrolytic plating apparatus for recovering metals from an electrolytic solution, comprising:

at least one walled cell container;

electronic rectifier means;

at least two outside anode means parallelly disposed within said container;

at least one central anode means comprising two surfaces, parallelly disposed between said outside anode means;

at least two cathode means parallelly and alternately disposed between said central anode means and said outside anode means;

means for horizontally circulating said electrolytic solution around said central anode means and between said central anode means and said cathode means, while simultaneously circulating said solution between said cathode means and said outside anode means;

means for deflecting the horizontal circulation of said solution circuitously about said central anode means, whereby the circulation of said fluid is in opposite directions, respectively, across said surfaces; and electronic signalling means, in said cell container, for detecting at least one process parameter selected from the group consisting of solution level, bath temperature, bath pH, flow rate, and solution chemistry.

70. An apparatus in accordance with claim 69 wherein said signalling means further comprises means for electronically switching a pump.

71. An electrolytic plating apparatus comprising:

a holding tank comprising a plurality of paired brackets means for supporting a plurality of electrolytic cell means;

a plurality of electrolytic cell means mounted upon said holding tank; and means for providing electrolyte flow directly between said holding tank and each of said electrolytic cell means.

72. An apparatus in accordance with claim 71 wherein said plurality of electrolytic cell means comprises a plurality of mounting flange means for engaging said plurality of paired brackets.

73. An electrolytic plating apparatus comprising:

holding tank means;

a plurality of electrolytic cell means mounted upon said holding tank means; and means for providing regulated electrolyte flow directly between said holding tank means and each of said electrolytic cell means, wherein said means for providing regulated electrolyte flow further comprise means for monitoring electrolyte flow.

* * * * *